US008776815B2

(12) United States Patent
Park et al.

(10) Patent No.: US 8,776,815 B2
(45) Date of Patent: Jul. 15, 2014

(54) MOUNTING ASSEMBLY FOR A COLLAPSIBLE CANOPY

(75) Inventors: Bumjun Park, Suzhou (CN); Martin James Dotterweich, Escondido, CA (US); Rusty George Summar, Brenham, TX (US)

(73) Assignee: HKD International (HK) Limited, North Point (HK)

( * ) Notice: Subject to any disclaimer, the term of this patent is extended or adjusted under 35 U.S.C. 154(b) by 794 days.

(21) Appl. No.: 12/438,684

(22) PCT Filed: Jul. 10, 2007

(86) PCT No.: PCT/US2007/073176

§ 371 (c)(1),
(2), (4) Date: Jun. 30, 2010

(87) PCT Pub. No.: WO2008/024565

PCT Pub. Date: Feb. 28, 2008

(65) Prior Publication Data

US 2010/0275962 A1 Nov. 4, 2010

Related U.S. Application Data

(60) Provisional application No. 60/839,861, filed on Aug. 24, 2006.

(51) Int. Cl.

| | |
|---|---|
| ***E04H 15/50*** | (2006.01) |
| ***E04H 15/64*** | (2006.01) |
| ***E04H 15/40*** | (2006.01) |

(52) U.S. Cl.

USPC ..... 135/145; 135/131; 135/146; 135/135; 135/119

(58) Field of Classification Search

USPC ..... 135/131, 146, 128, 130, 143, 144, 145, 135/135, 155

See application file for complete search history.

(56) References Cited

U.S. PATENT DOCUMENTS

| | | | |
|---|---|---|---|
| 2,230,454 | A | 2/1941 | Friesner et al. |
| 2,704,963 | A | 3/1955 | Parachek |
| 4,165,757 | A | 8/1979 | Marks |
| 4,265,261 | A | 5/1981 | Barker |
| 4,607,656 | A | 8/1986 | Carter |
| 4,779,635 | A | 10/1988 | Lynch |
| 4,838,293 | A | 6/1989 | Novak |

(Continued)

OTHER PUBLICATIONS

Korean Intellectual Property Office: Technical Evaluation Decision "Automatic Tent with Snap Through" Application Date: Feb. 9, 2004.

(Continued)

*Primary Examiner* — David R Dunn
*Assistant Examiner* — Danielle Jackson
(74) *Attorney, Agent, or Firm* — Polster Lieder

(57) ABSTRACT

A collapsible shelter assembly includes legs, a truss system, a cover, cover supporting rods and mounting brackets. Each of the legs has an upper and a lower end. The truss system is configured to link each pair of legs together and define a base perimeter. The brackets are adapted for mounting to the upper ends of the legs, for attaching to the rods at a predefined distance distal to ends of the rods and for defining an outer perimeter greater than the base perimeter. The cover is adapted for attaching about the ends of the rods for covering the outer perimeter.

29 Claims, 9 Drawing Sheets

(56) References Cited

U.S. PATENT DOCUMENTS

| | | | | |
|---|---|---|---|---|
| 4,876,829 | A | 10/1989 | Mattick | |
| 4,898,085 | A | 2/1990 | Jarnot | |
| 4,979,531 | A | 12/1990 | Toor et al. | |
| 5,005,322 | A | 4/1991 | Mattick et al. | |
| 5,467,794 | A | 11/1995 | Zheng | |
| 5,485,863 | A | 1/1996 | Carter | |
| 5,490,533 | A | 2/1996 | Carter | |
| 5,511,572 | A | 4/1996 | Carter | |
| 5,632,292 | A | 5/1997 | Carter | |
| 5,632,293 | A | 5/1997 | Carter | |
| 5,655,340 | A | 8/1997 | Pelsue | |
| 5,797,412 | A | 8/1998 | Carter | |
| 5,813,425 | A | 9/1998 | Carter | |
| 5,921,260 | A | 7/1999 | Carter | |
| 5,934,301 | A | 8/1999 | Carter | |
| 6,035,887 | A | 3/2000 | Cato | |
| 6,041,800 | A | 3/2000 | Carter | |
| 6,070,604 | A | 6/2000 | Carter | |
| 6,076,312 | A | 6/2000 | Carter | |
| 6,089,247 | A | 7/2000 | Price | |
| 6,129,102 | A | 10/2000 | Carter | |
| 6,138,702 | A | 10/2000 | Carter | |
| 6,192,910 | B1 | 2/2001 | Carter | |
| 6,230,729 | B1 | 5/2001 | Carter | |
| 6,240,940 | B1 | 6/2001 | Carter | |
| 6,363,956 | B2 | 4/2002 | Carter | |
| 6,382,224 | B1 | 5/2002 | Carter | |
| 6,397,872 | B1 | 6/2002 | Carter | |
| 6,412,507 | B1 | 7/2002 | Carter | |
| 6,431,193 | B2 | 8/2002 | Carter | |
| 6,439,251 | B2 | 8/2002 | Carter | |
| 6,470,902 | B1 | 10/2002 | Carter | |
| 6,502,597 | B2 | 1/2003 | Carter | |
| 6,520,196 | B2 | 2/2003 | Carter | |
| 6,601,599 | B2 | 8/2003 | Carter | |
| D485,928 | S | 1/2004 | Leung et al. | |
| 6,679,643 | B1 | 1/2004 | Ham | |
| 6,701,949 | B2 | 3/2004 | Carter | |
| 6,708,707 | B2 | 3/2004 | Dotterweich et al. | |
| 6,712,083 | B2 | 3/2004 | Carter | |
| 6,718,995 | B2 | 4/2004 | Dotterweich | |
| 6,748,963 | B2 | 6/2004 | Carter | |
| 6,763,841 | B1 | 7/2004 | Cantwell | |
| 6,796,320 | B2 | 9/2004 | Carter | |
| 6,868,858 | B2 | 3/2005 | Suh | |
| 6,874,520 | B2 | 4/2005 | Carter | |
| 6,920,889 | B2 | 7/2005 | Carter | |
| 6,926,021 | B2 | 8/2005 | Carter | |
| 6,981,510 | B2 | 1/2006 | Carter | |
| 7,025,075 | B2 * | 4/2006 | Suh | 135/145 |
| 7,051,745 | B2 | 5/2006 | Carter | |
| 7,178,541 | B2 | 2/2007 | Carter | |
| 7,178,542 | B2 | 2/2007 | Carter | |
| 7,182,092 | B1 | 2/2007 | Cantwell | |
| 7,275,555 | B2 * | 10/2007 | Powell et al. | 135/122 |
| 2004/0020369 | A1 | 2/2004 | Long et al. | |
| 2004/0020484 | A1 | 2/2004 | Skidmore et al. | |
| 2005/0120640 | A1 | 6/2005 | Cantwell | |
| 2005/0241688 | A1 * | 11/2005 | Wu | 135/145 |
| 2006/0032524 | A1 | 2/2006 | Carter | |
| 2006/0060235 | A1 * | 3/2006 | Ball | 135/136 |
| 2006/0118155 | A1 | 6/2006 | Carter | |
| 2006/0174929 | A1 | 8/2006 | Tseng | |
| 2007/0028954 | A1 | 2/2007 | Carter | |
| 2007/0221262 | A1 * | 9/2007 | Tsai et al. | 135/145 |

OTHER PUBLICATIONS

Korean Intellectual Property Office (KR), Laid Open Patent Publication, "Automatic Tent with Snap-Thru", May 17, 2005.

* cited by examiner

MOUNTING ASSEMBLY FOR A COLLAPSIBLE CANOPY

CROSS-REFERENCE TO RELATED APPLICATIONS

This application is a United States national phase under 35 USC §371 of PCT/US2007/073176, filed Jul. 10, 2007, which claims the benefit of U.S. Provisional Application No. 60/839,861, filed on Aug. 24, 2006, and entitled COLLAPSIBLE STRUCTURE. The disclosure of the above application is incorporated herein by reference.

FIELD

The present disclosure relates to collapsible structures and, more specifically, to a canopy beam mounting assembly for a collapsible canopy.

BACKGROUND

The statements in this section merely provide background information related to the present disclosure and may not constitute prior art.

There are a number of temporary shelters that can be transported and rapidly set up for a variety of uses. In general, these structures include an underlining or supporting frame, which includes at least three, and often four-corner posts or legs. Commonly, the legs are in two parts arranged to telescope within one another so as to define a lower retracted position and an extended position for use. A supporting beam or brace structure is attached to each of the legs at an upper fixed position and at the lower position at a slider moveably mounted on the leg. The slider moves with and on the leg to an extended position for use. The beam structure conventionally is a "scissors" arrangement, which enables the legs and beam structure to be compressed into a low profile configuration for transporting or storage. A supporting frame is coupled to the legs to support a canopy.

Typically, these existing canopy support assemblies work well for their intended purpose, their structures are relatively expensive to manufacture and do not lend themselves easily to the adoption of a variety of canopy top configurations. Additionally, the coverage area of canopy is limited to the footprint defined by the legs.

SUMMARY

The inventors hereof have succeeded at designing a canopy support assembly that is in improvement over existing assemblies.

According to one aspect, a collapsible shelter assembly includes legs, a truss system, a cover, cover supporting rods and mounting brackets. Each of the legs has an upper and a lower end. The truss system is configured to link each pair of legs together and define a base perimeter. The brackets are adapted for mounting to the upper ends of the legs, for attaching to the rods at a predefined distance distal to ends of the rods and for defining an outer perimeter greater than the base perimeter. The cover is adapted for attaching about the ends of the rods for covering the outer perimeter.

According to another aspect, a collapsible shelter assembly having a plurality of legs, each of the legs having an upper, and a lower end, a truss system linking each pair of legs together and defining a base perimeter, and a cover, includes a plurality of rods configured to support the cover, means for mounting each rod to an upper end of one of the legs, and means for attaching the cover to each rod. The means for mounting and the means for attaching are configured for defining a perimeter of the cover that is greater than the base perimeter.

According to still another aspect, a collapsible shelter assembly has a plurality of legs, each of the legs having an upper, and a lower end, a truss system linking each pair of legs together and defining a base perimeter, and a plurality of rods configured for supporting a canopy. The assembly comprises a plurality of brackets and a cover. Each bracket has a base adapted for mounting to one of the legs. Each bracket also has a coupler with a bore for receiving one of the rods and extending a predefined length of the received rod for defining an outer perimeter that is greater than the base perimeter. The cover is supported by the rods to form the canopy for covering the outer perimeter when the rods are attached to the brackets and the brackets are attached to the upper ends of the legs. The cover includes a corner having a rod attachment mechanism for attaching the cover to ends of the rods.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

The following description is merely exemplary in nature and is not intended to limit the present disclosure or the disclosure's applications or uses.

Figure 1:
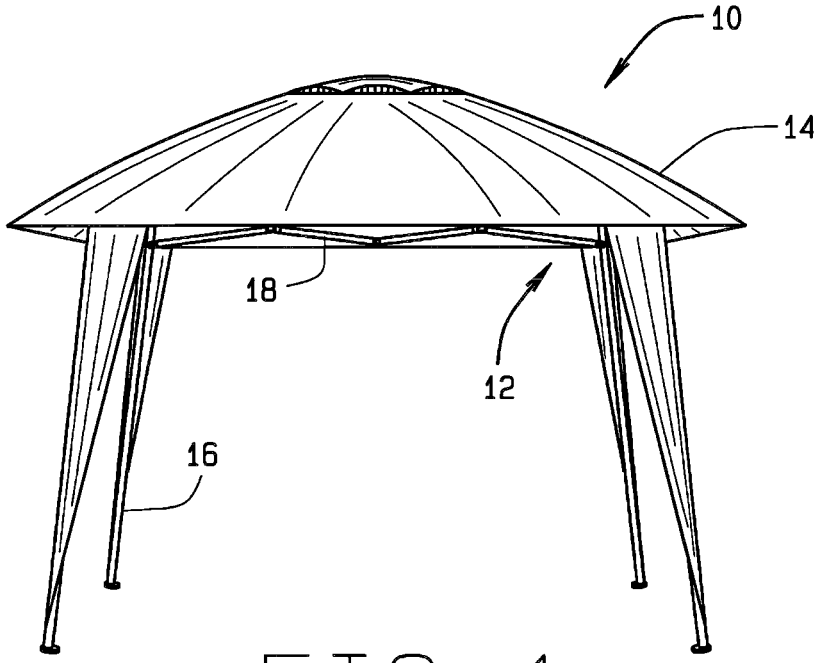
FIG. 1 is a side perspective view of an erected collapsible canopy shelter having a canopy support structure mounting assembly according to one exemplary embodiment.
Figure 2:
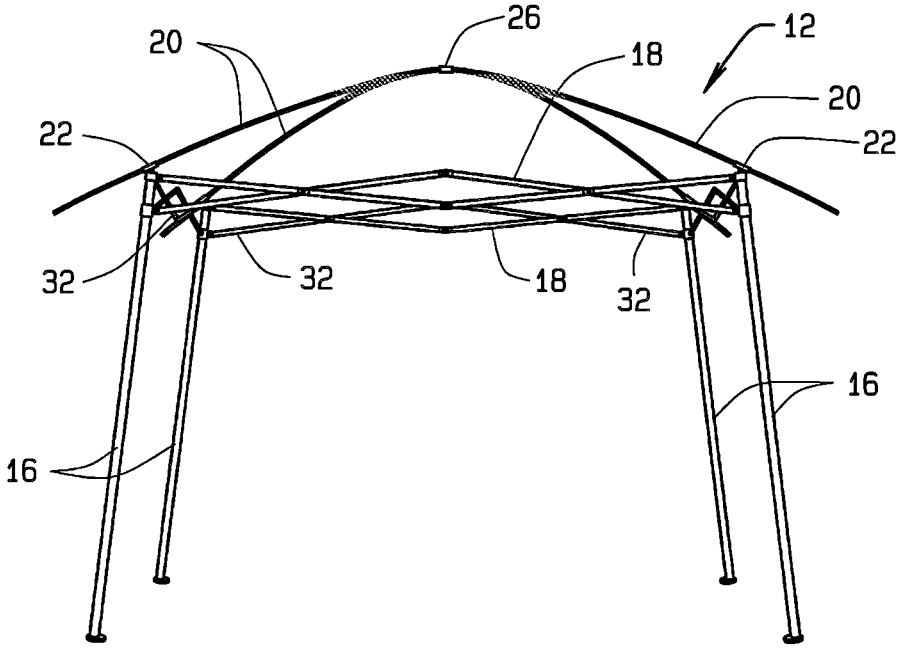
FIG. 2 is a side perspective view of an erected support structure having a canopy mounting assembly according to one exemplary embodiment.
Figure 3:
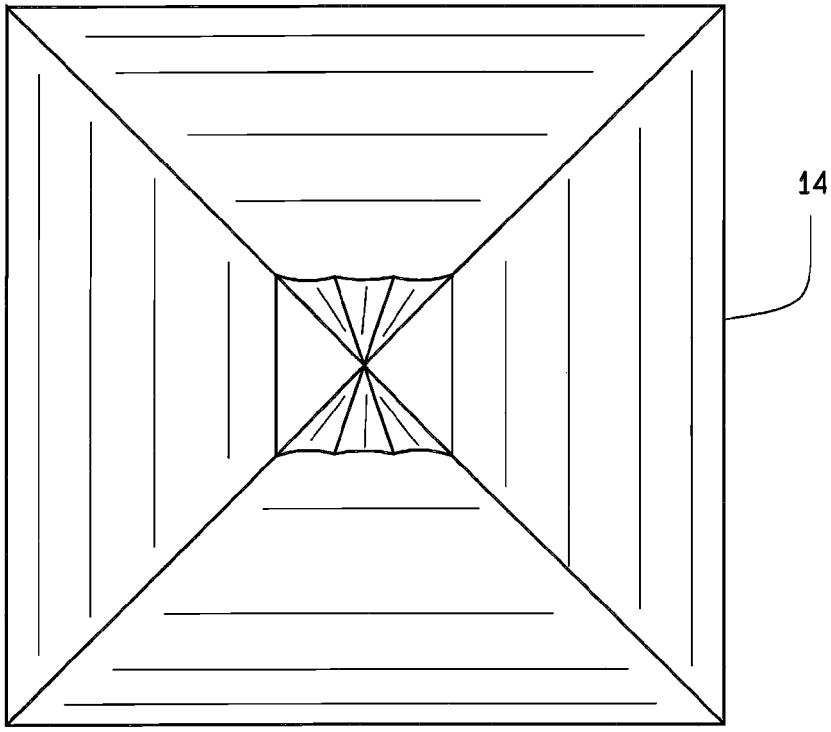
FIG. 3 is a top view of an erected collapsible canopy shelter according to one exemplary embodiment.
Figure 4:
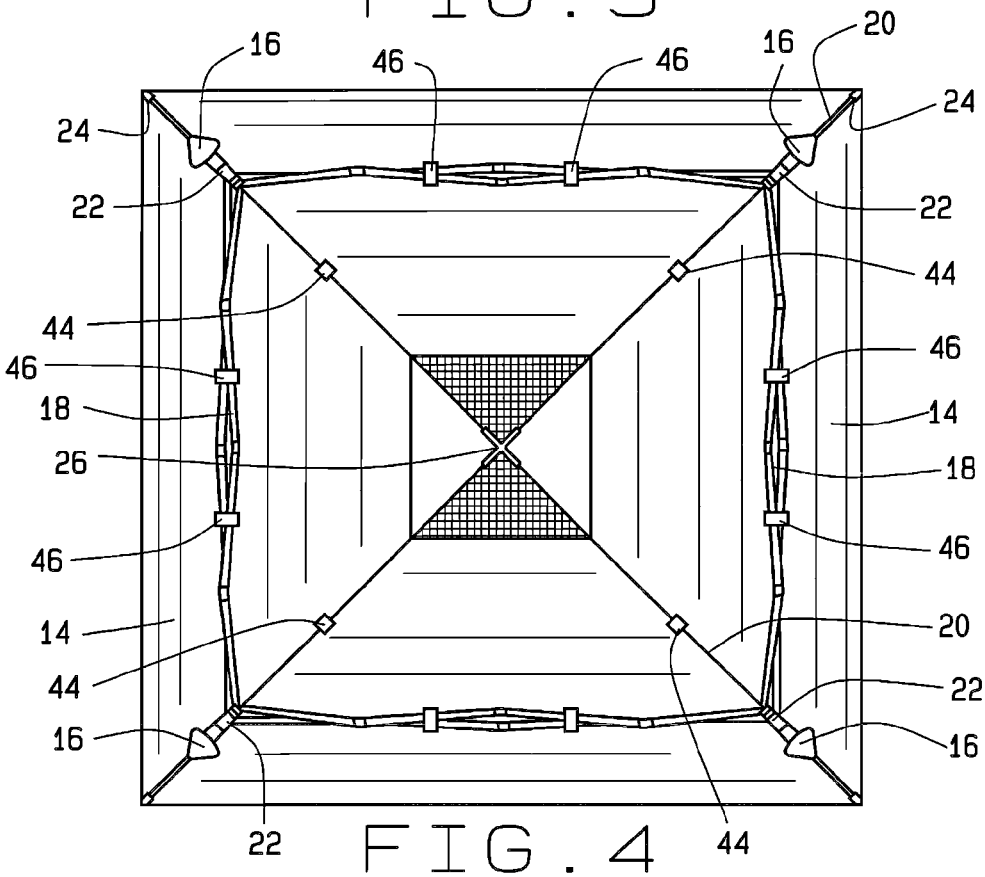
FIG. 4 is a bottom view of an erected collapsible canopy shelter according to the embodiment of FIG. 3.
Figure 5:
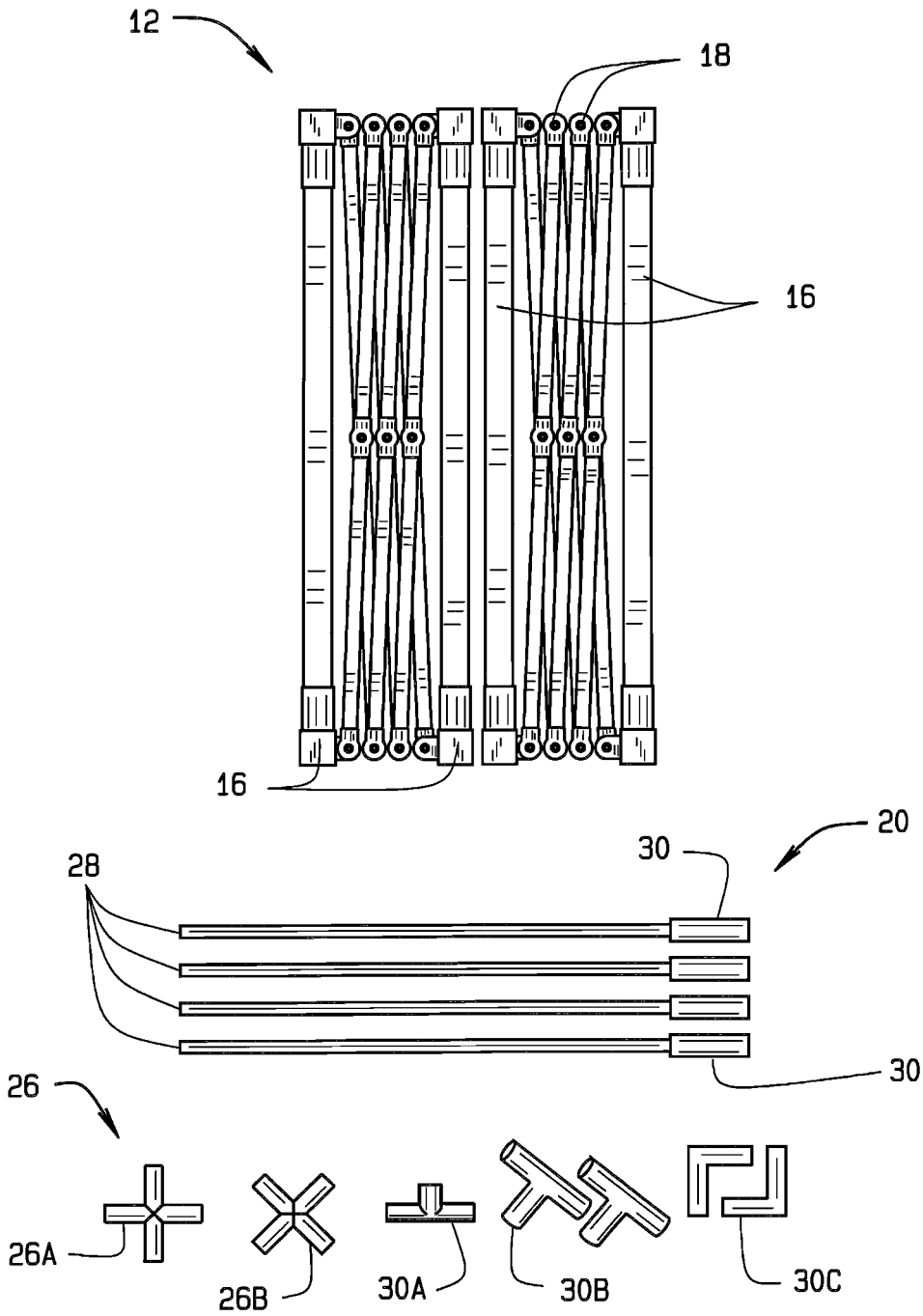
FIG. 5 is a side view of a collapsed canopy shelter having a canopy support structure mounting assembly according an exemplary embodiment.
Figure 6:
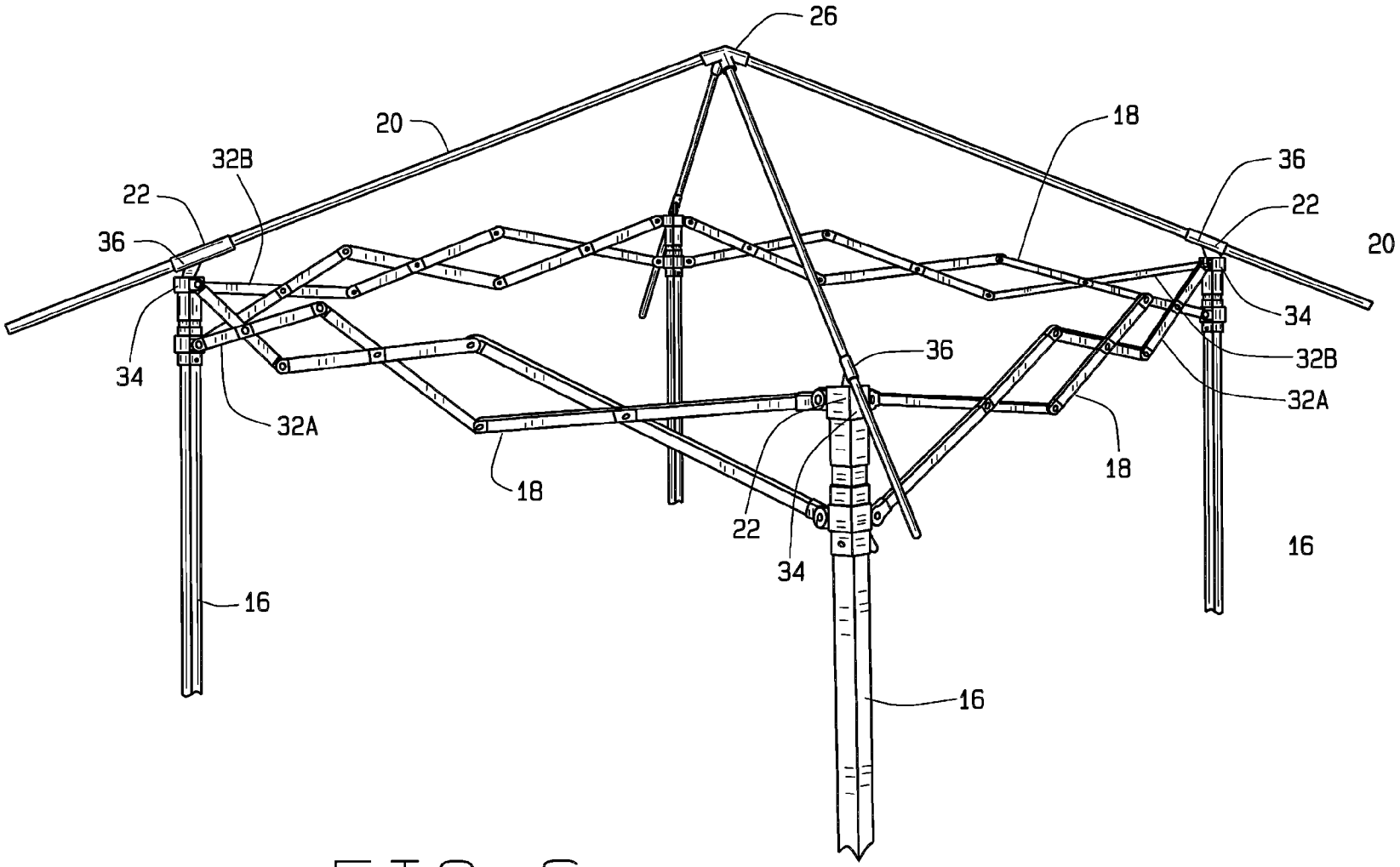
FIG. 6 is a top perspective view of a canopy support structure having a canopy support bracket assembly according to one exemplary embodiment.
Figure 7A:
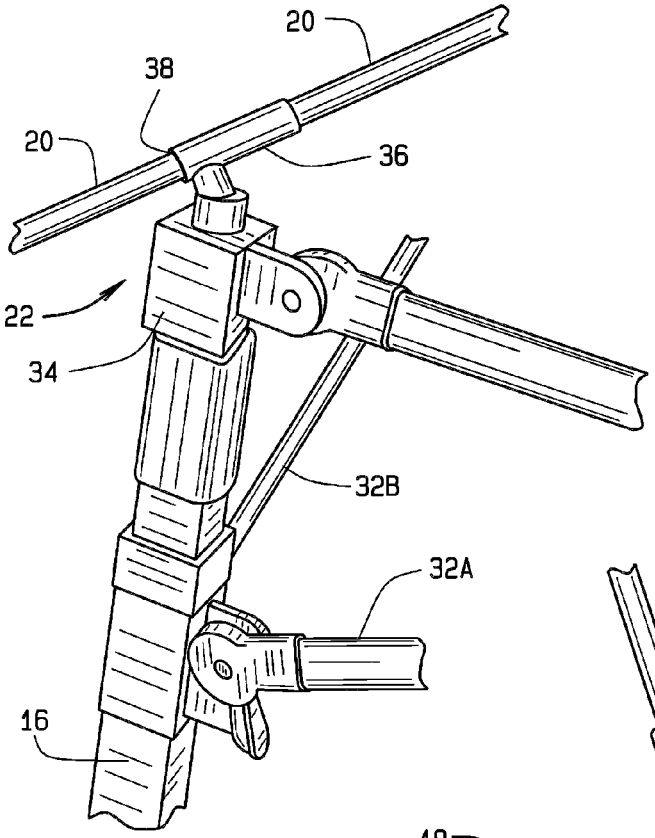
FIGS. 7A and 7B are a two perspective views of a canopy support bracket and leg assembly beam according to another exemplary embodiment.
Figure 7B:
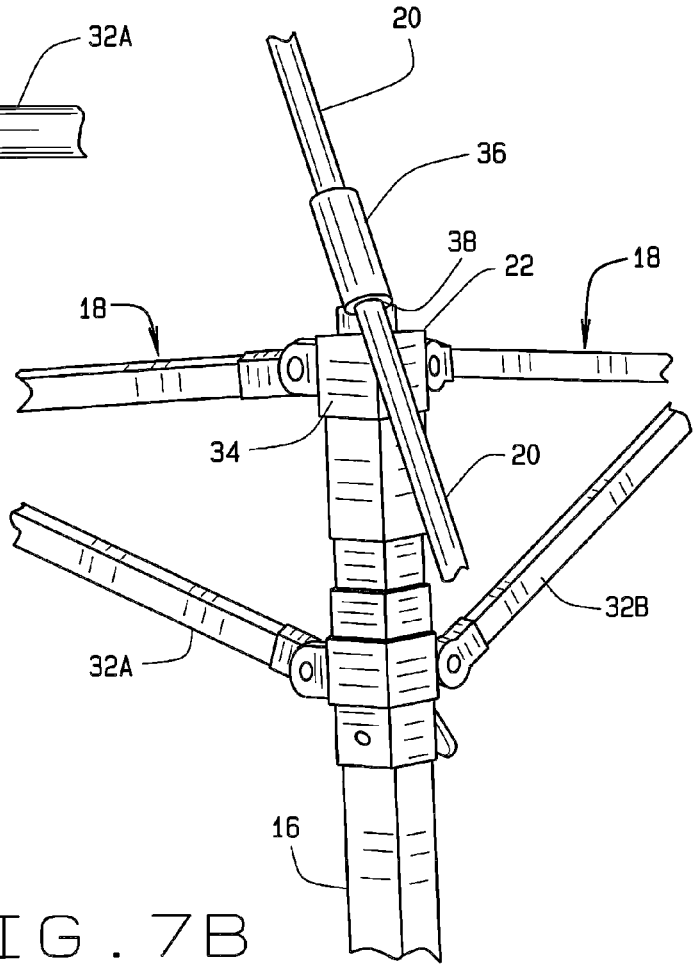

In one embodiment, a collapsible shelter assembly 10 such as those shown in FIGS. 1, 2, 3, 4, 5 and 6 includes a canopy support structure 12 and a canopy cover 14. The canopy support structure 12 includes legs 16, a truss system 18, cover supporting rods 20 and mounting brackets 22. FIG. 5 illustrates the canopy support structure 12 in a collapse form, such as a kit prior to erection of the canopy support structure 12.

Figure 10A:
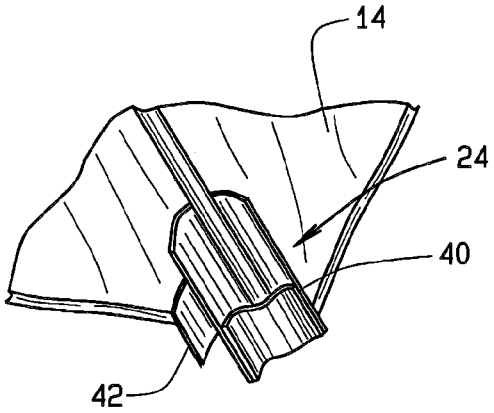
FIGS. 10A and 10B are bottom perspective views of a cover having a rod attachment mechanism according one embodiment.
Figure 10B:
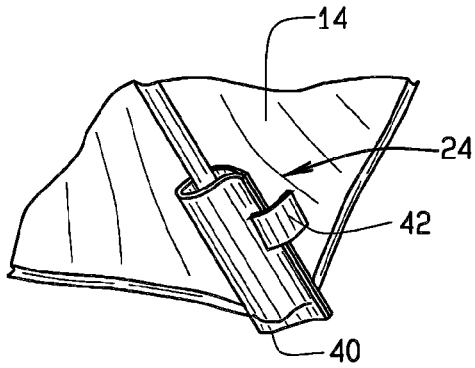
Figure 11A:
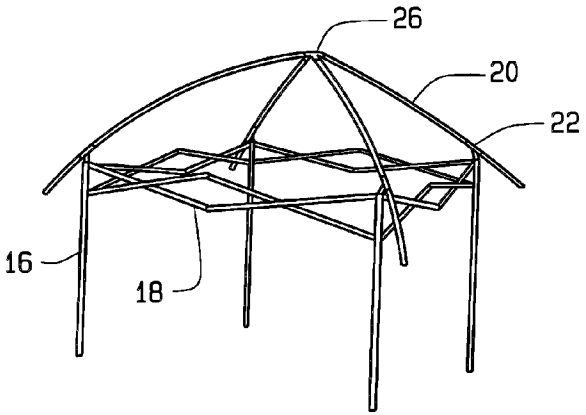
FIGS. 11A, 11B, 11C, and 11D are side perspective views of four different erected support structures according to four exemplary embodiments.
Figure 11B:
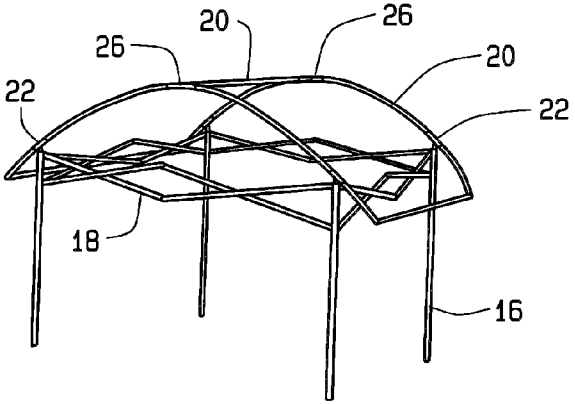
Figure 11C:
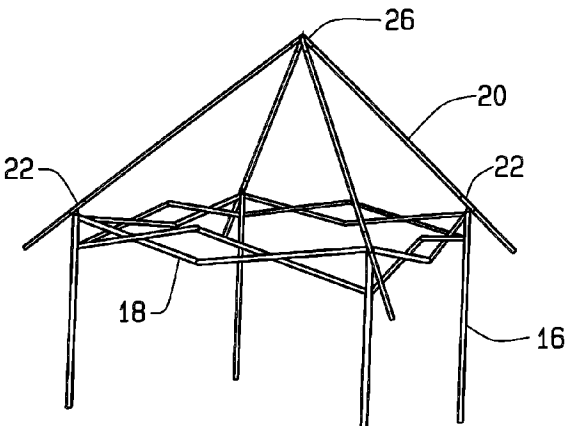
Figure 11D:
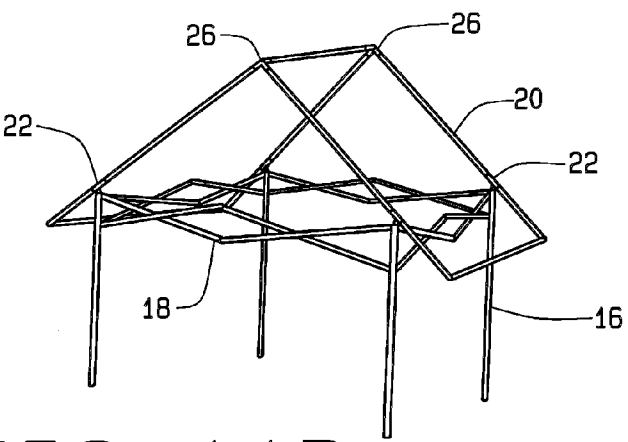

The canopy cover 14 is adapted for attaching about the ends of the rods 20 for covering the outer perimeter as defined by the rods 20. The cover 14 can include, in some embodiments, a rod attachment mechanism 24 for releasably attaching the cover 14 to the rods 20. Also see FIGS. 10A and 10B. For example, the rod attachment mechanism 24 can include a pocket 40 formed in the cover 14 that is dimensioned receiving a portion, such as an end, of a rod 20. A retaining feature 42, shown in FIGS. 10A and 10B can also secure the end of the rod 20 within the pocket 40. For example, a strap, tie, hook and loop tabs or flaps can cover or otherwise secure the rod 20 within the pocket 40 or to the cover 14. One or more securing fasteners 44 can also be provided on the cover 14 or on the rod 20, or jointly for coupling the cover 14 to the rods 20, as shown in FIG. 4. These can include, but are not limited to, straps, hooks, snaps, loops and pockets. Similarly, the cover 14 can include a truss attachment mechanism 46, also as shown in FIG. 4, for releasably attaching the cover 14 to the truss system 18. These two can include a strap, hook, tie, flaps, or pocket.

The cover 14 can be of any design. For example, in some embodiments, includes an outer edge that forms the canopy outer perimeter that has a catenary or substantially catenary cut or shape. In other embodiments, the edge of the cover 14 is straight, curved, or sculpted.

Figure 12A:
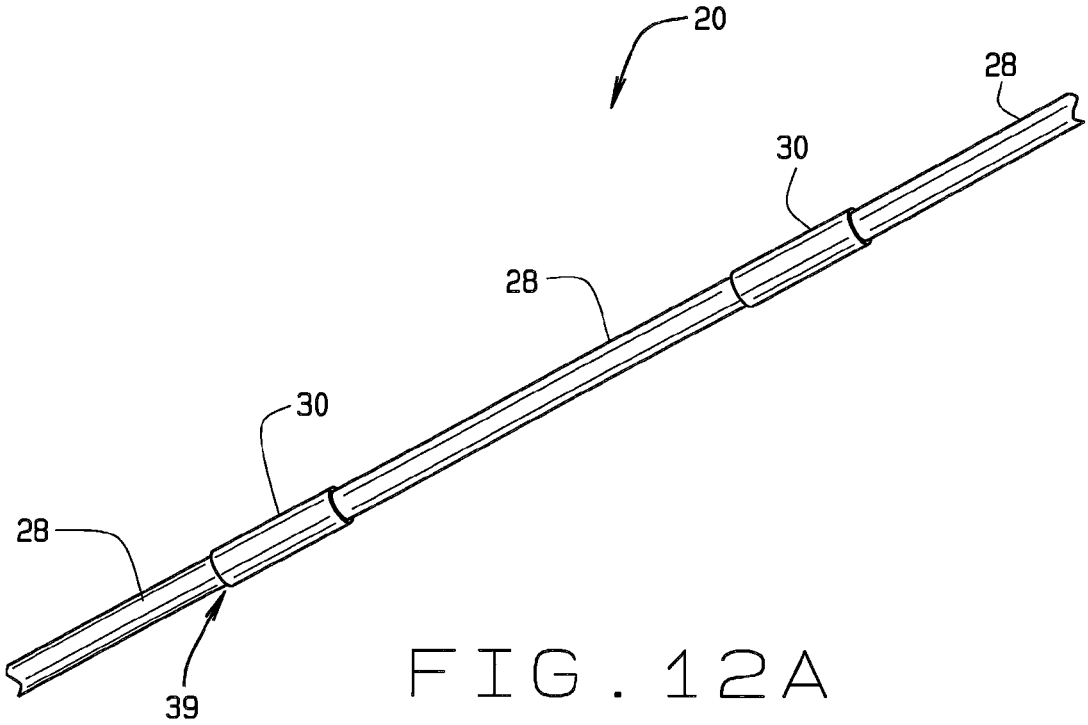
FIG. 12A is a side perspective view of a multi-segment canopy support rod according to one exemplary embodiment.

The rod 20 can be a single rod that traverses between two adjacent or non-adjacent legs 16. In other embodiments, the rods 20 or can be dimensioned for coupling at one or more points to form a canopy structure 12 having a predefined shape. For example, the rods 20 can be configured to form a canopy support structure 12 for a canopy cover 14 having a pyramid, a dome, a hut, or an arch shape. In some embodiments, a hub 26 or a multi-rod connector 30 can be utilized for attaching two or more rods 20. FIG. 5 includes a group of disassembled rod segments 28 with connectors 30 that can be assembled for forming one or more rods 20 as shown in FIG. 12A. Also shown are a variety of different hubs 26 and connectors 30 for rod segments 28. The rods 20 can be a solid structure or can be a tube structure and can be rigid or flexible. In some embodiments, metal or composite, such as fiberglass, tube segments 28 are utilized with an elastic member (not shown) within the tube segment 28 for forming each rod 20 and for aiding in the assembly and storing of the rods 20. In other embodiments, rod segments 28 include connectors 30 for coupling a first rod segment 28 to a second rod segment 28 to form a rod 20.

The truss system 18 is configured to link each pair of legs 16 together and define a base perimeter or mounting footprint. The truss system 18 can be of any design or construction but in some embodiments includes pairs of link members 32 connected to each of the legs 16. The link member pairs 32 each have a first end connected to one leg 16A and a second end connected to another leg 16B. Each link member pair 32 is connected with a scissors design that permits the folding of each link member 32 for collapsing and erecting the collapsible canopy support structure 12.

The brackets 22 are adapted for mounting to the upper ends of the legs 16, for attaching to the rods 20 at a predefined distance distal to ends of the rods 20 and for defining an outer perimeter greater than the base perimeter. Generally, the rods 20 extend outwardly beyond the legs 16 and truss system 18. The amount of extension beyond the legs 16 and truss system 18 can vary from one embodiment to another and can be adjustable in some embodiments. For example, in one embodiment, the rods 20 extend to between about 6 and about 24 inches outward from the legs 16. In this manner, the area covered by the cover 14 is greater than the mounting footprint defined by the legs 16 and the truss system 18. In some embodiments, this extension can not only provide for increased covered area, but also add to the variations of canopy design shapes available for the canopy assembly 10 and can provide for use of the canopy support structure 12 for multiple different canopy covers 14, each having a different shape. Some examples are shown in FIGS. 11A, 11B, 11C, and 11D. As such, the same legs 16 and truss system 18 can be utilized with different brackets 22, rods 20, stops 39, hubs 26 and canopy covers 14 for creating different shaped canopy shelter assemblies 10.

Figure 8A:
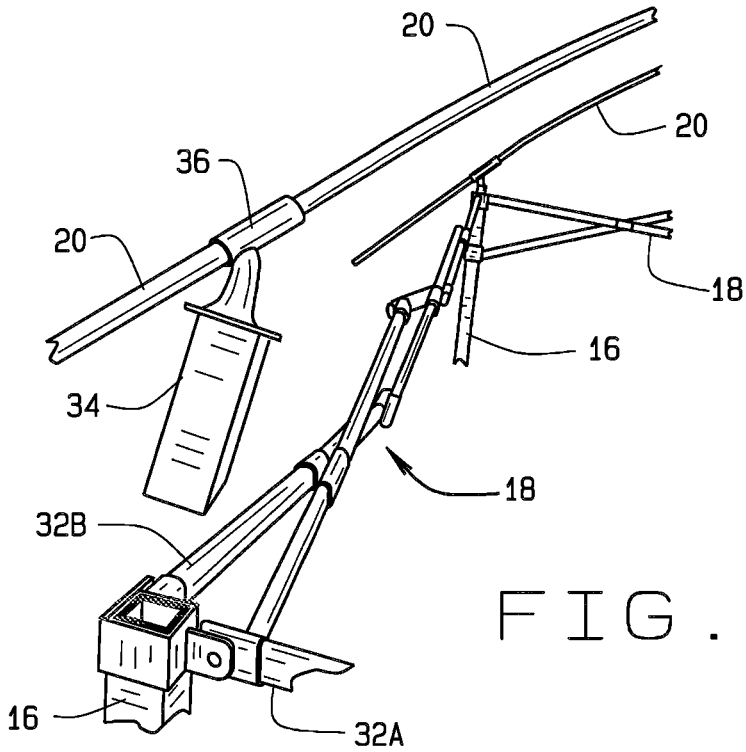
FIGS. 8A and 8B are two perspective views of a canopy support rod and bracket assembly according to two additional exemplary embodiments.
Figure 8B:
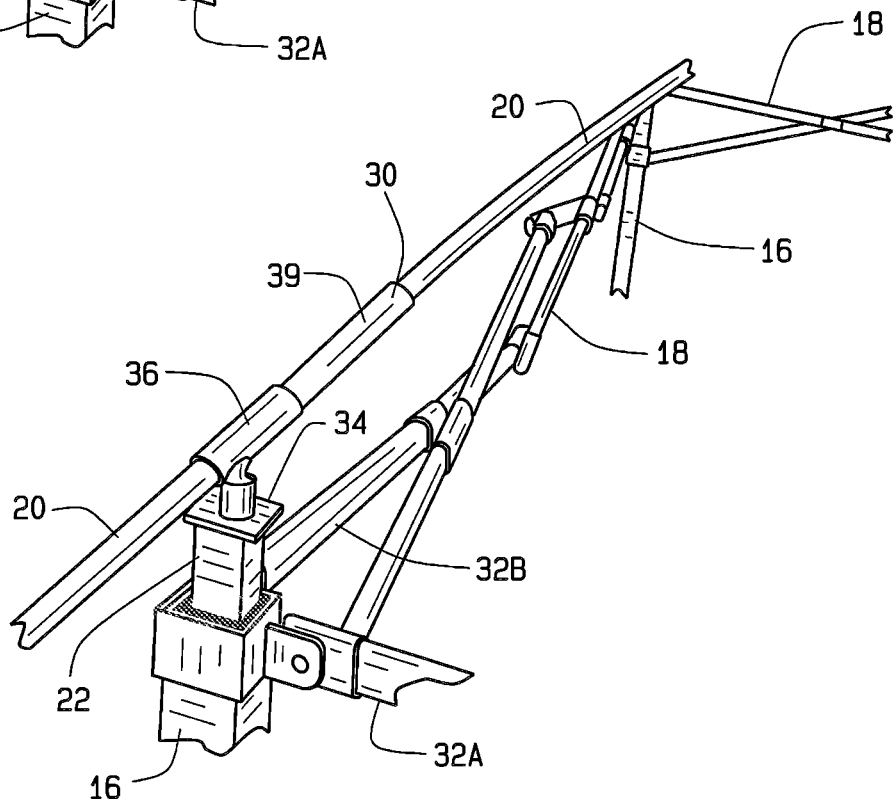
Figure 9:
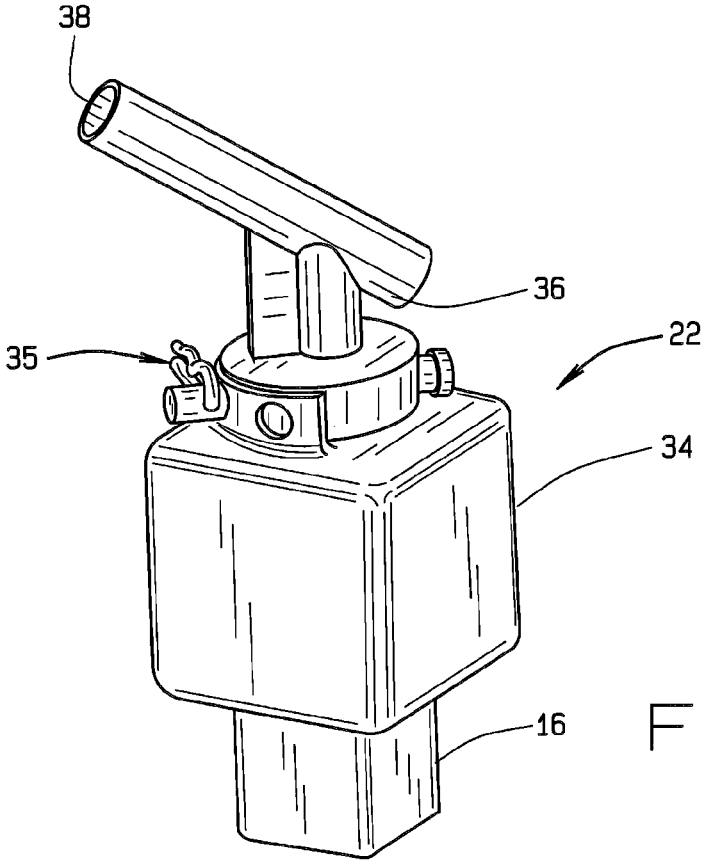
FIG. 9 is a side perspective view of an adjustable canopy support bracket according to one exemplary embodiment.

In some embodiments, each bracket 22 includes a base 34 for mounting to the upper end of a leg 16 and a coupler 36 for attaching to one of the rods 20 as shown in FIGS. 7A, 7B, 8A, 8B, and 9, by way of examples. The coupler 36 can have a receptacle 38 for receiving and passing a portion of the rod 20 there through to enable the end portion of the rod 20 to extend beyond the coupler 36 and outward from the leg 16. The receptacle 38 can be a bore or hole dimensioned for receiving and passing a portion of a rod 20, as shown in FIG. 9 or can be a saddle or other design capable of attaching to rod 20, not shown. As shown in FIGS. 8A and 8B the coupler 36 can be fixed relative to the base 34 or can be rotatable or otherwise adjustable, as shown by way of example in FIG. 9. As shown here, a locking mechanism 35 can lock the coupler 36 relative to the base 34. The base 34 can be attached to the leg 16 in any manner. As shown if FIGS. 8A and 8B, the base 34 can be configured to insert into a top portion of the leg 16 or can be adapted to receive the top portion of the leg 16 as illustrated in FIG. 9.

Figure 12B:
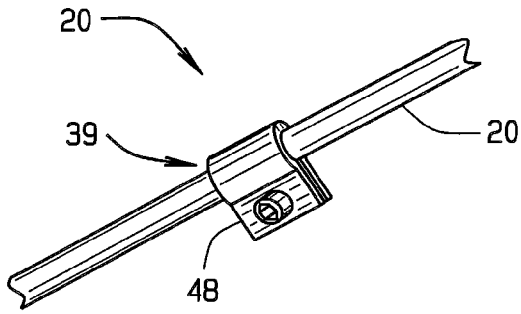
FIG. 12B is a side perspective view of a rod and stop according to one exemplary embodiment.

In some embodiments, the rods 20 are configured with an integrated or attached stop 39 as shown in FIG. 8B that prevents the rod 20 from extending past the coupler 36 and therefore determined the predefined distance from the end of the rod 20 that extends beyond the leg 16. By engaging the coupler 36 and limiting the length of the rod 20 that extends externally, such the stop 39 can define the outer perimeter as well as the height of the canopy support assembly 20 and therefore the height of the canopy cover 14. The stop 39 can be adjustable such as a clamp 48 placed around the rod 20 such as illustrated in FIG. 12B or through one or more holes on the rod. In other embodiments, the stop 39 can be integrated with the rod 16 as a protrusion or other rod feature. Where the rod 20 has multiple rod segments 28, the rod segment connector 30 can be the stop 39 as illustrated in FIG. 12A.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A collapsible shelter assembly comprising:

a plurality of legs, each of the legs having an upper, and a lower end;

a truss system linking each pair of legs together, the truss system and legs defining a base perimeter, the truss system includes pairs of rigid link members connected to each of the legs, the link member pairs having a first end connected to one leg and a second end connected to another leg, and having a scissors link permitting folding of each link member;

a cover;

a plurality of rods adapted for supporting the cover; and a plurality of brackets each having a base selectably mountable directly to the upper ends of the legs during assembly of the shelter and removable therefrom during disassembly of the shelter and a coupler attaching to the rods at a predefined distance distal to ends of the rods and defining an outer perimeter greater than the base perimeter, wherein the cover is adapted for selectably attaching about the ends of the rods during assembly and use of the shelter for covering the outer perimeter and detachment therefrom during disassembly of the shelter, wherein each rod includes a plurality of rod segments and one or more connectors for coupling the rod segments to form the rod, and wherein at least one of the connectors is configured for engaging the bracket for establishing the predefined distance.

2. The assembly of claim 1 wherein each leg defines a cavity on the upper end and wherein each bracket base is selectably insertable into the cavity of the upper end of a leg during assembly and use of the shelter and removable from the cavity of the upper end of the leg during disassembly of the shelter, the coupler having a receptacle receiving and passing the portion of the rod there through and extending the passed through portion of the rod outward from the coupler the predefined distance.

3. The assembly of claim 2 wherein the coupler includes a bore as the receptacle, the bore being dimensioned for receiving and passing a portion of at least one of the rods therethrough.

4. The assembly of claim 1 wherein each rod segment is a tube and each rod includes an elastic member configured for releasably attaching the segments together to form the rod.

5. The assembly of claim 1, further comprising a plurality of different rod couplers wherein the rods are selectably configurable by a user with use of a different rod coupler during assembly of the shelter assembly to form a shelter having each of a plurality of canopy configurations including a pyramid, a dome, a hut, and an arch.

6. The assembly of claim 1 wherein the cover includes a rod attachment mechanism for releasably attaching the cover to the rods during assembly of the shelter assembly and detachment during disassembly of the shelter assembly, the rod attachment mechanism of the cover including a retaining feature for selectively securing each end of the rod therein, wherein the cover includes corners and wherein the rod attachment mechanism includes a plurality of pockets formed in the corners of the cover, each pocket being configured for receiving an end of one of the rods.

7. The assembly of claim 1 wherein the cover includes a rod attachment mechanism for releasably attaching the cover to the rods during assembly of the shelter assembly and detachment during disassembly of the shelter assembly, the rod attachment mechanism of the cover including a retaining feature for selectively securing each end of the rod therein, the rod attachment mechanism includes pocket in the cover for receiving each end of one of the rods and wherein the retaining feature including a hook and loop construction for selectively securing each end of the rods within one of the pockets.

8. The assembly of claim 1 wherein each of the rods is a flexible rod formed by three or more rod segments, each of which is connected by one of two or more connectors.

9. The assembly of claim 1 wherein the brackets are selectably attachable to the rods at a predefined distance distal to ends of the rods during erection of the shelter assembly and removable from the rods during disassembly for defining an outer perimeter greater than the base perimeter.

10. The assembly of claim 1 wherein each pair of rigid link members connected to each leg has an upper member rotatably attached to an upper end of the leg at a fixed position and a lower member selectably rotatably and slidably coupled to the leg in a lower position during disassembly of the shelter and an upper position during assembly and use of the shelter.

11. The assembly of claim 1 wherein each leg defines a cavity on the upper end and each bracket has a base insertable into the cavity of the upper end of the leg during assembly and use of the shelter and removable therefrom during disassembly of the shelter and a coupler that has a receptacle having a rod received therein.

12. The assembly of claim 1 wherein each bracket is either a unibody defining the coupler and the base or the coupler is fixed relative to the base.

13. A collapsible shelter assembly having a plurality of legs, each of the legs having an upper, and a lower end, a truss system linking each pair of legs together and defining a base perimeter, a plurality of rods configured for supporting a canopy, the assembly comprising:

a plurality of brackets, each bracket having a base adapted for selectably mounting directly to the upper end of one of the legs during assembly of the shelter and removable therefrom during disassembly of the shelter and a coupler having a bore receiving the passing therethrough of one of the rods and extending a predefined length of the received rod outward from the bracket and the leg defining an outer perimeter that is greater than the base perimeter; and a cover configured to be selectably supported by the rods to form the canopy for covering the outer perimeter when the rods are attached to the brackets during assembly of the shelter and removable therefrom during disassembly of the shelter and the brackets are selectably attached to the upper ends of the legs, the cover including a corner having a rod attachment mechanism for selectably attaching the cover to ends of the rods during assembly of the shelter and detachable therefrom during disassembly of the shelter; and wherein each rod includes a stop for limiting the length of rod received by the bore of the bracket and defining the predefined length and wherein each rod includes a plurality of rod segments and one or more connectors for coupling the rod segments to form the rod, and wherein at least one of the connectors is the stop that is an integrated feature of the rod for predefining the distance.

14. The assembly of claim 13 wherein the rod attachment mechanism includes a pocket in the cover for receiving the end of the rod and a retaining feature having a hook and loop construction for selectively securing the end of the rod within the pocket.

15. The assembly of claim 13 wherein each leg defines a cavity on the upper end and wherein each bracket is fixedly coupled to one of the rods at the predefined distance, each bracket having a base selectably insertable into the cavity of the upper end of a leg during assembly and use of the shelter and selectably removable from the cavity of the upper end of the leg during disassembly of the shelter.

16. The assembly of claim 13 wherein the brackets are selectably attachable to the rods at a predefined distance distal to ends of the rods during erection of the shelter assembly and removable from the rods during disassembly for defining an outer perimeter greater than the base perimeter.

17. The assembly of claim 13, further comprising a plurality of different rod couplers wherein the rods are selectably configurable by a user with use of a different rod coupler during assembly of the shelter assembly to form a shelter having each of a plurality of canopy configurations including a pyramid, a dome, a hut, and an arch.

18. The assembly of claim 13 wherein each bracket is either a unibody defining the coupler and the base or the coupler is fixed relative to the base.

19. A collapsible shelter assembly comprising:

a plurality of legs, each of the legs having an upper, and a lower end;

a truss system linking each pair of legs together, the truss system and legs defining a base perimeter, the truss system includes pairs of rigid link members connected to each of the legs, the link member pairs having a first end connected to one leg and a second end connected to another leg, and having a scissors link permitting folding of each link member;

a cover;

a plurality of rods adapted for supporting the cover; and a plurality of brackets adapted for selectably mounting to the upper ends of the legs during assembly of the shelter and removable therefrom during disassembly of the shelter and attaching to the rods at a predefined distance distal to ends of the rods and defining an outer perimeter greater than the base perimeter, wherein the cover is adapted for selectably attaching about the ends of the rods during assembly and use of the shelter for covering the outer perimeter and detachment therefrom during disassembly of the shelter, wherein each bracket is fixedly coupled to one of the rods at the predefined distance, each bracket having a base for selectably mounting to the upper end of a leg during assembly and use of the shelter and selectably removable from the upper end of the leg during disassembly of the shelter.

20. The assembly of claim 19 wherein each leg defines a cavity on the upper end and wherein each bracket a base is selectably insertable into the cavity of the upper end of a leg during assembly and use of the shelter and removable from the cavity of the upper end of the leg during disassembly of the shelter, wherein each bracket includes a coupler having a receptacle receiving and passing the portion of the rod there through and extending the passed through portion of the rod outward from the coupler the predefined distance.

21. The assembly of claim 20 wherein the coupler includes a bore as the receptacle, the bore being dimensioned for receiving and passing a portion of at least one of the rods therethrough.

22. The assembly of claim 19 wherein each of the rods is a flexible rod formed by three or more rod segments, each of which is connected by one of two or more connectors.

23. A collapsible shelter assembly comprising:

a plurality of legs, each of the legs having an upper, and a lower end;

a truss system linking each pair of legs together, the truss system and legs defining a base perimeter, the truss system includes pairs of rigid link members connected to each of the legs, the link member pairs having a first end connected to one leg and a second end connected to another leg, and having a scissors link permitting folding of each link member;

a cover;

a plurality of rods adapted for supporting the cover;

a plurality of brackets each having a base selectably mountable directly to the upper ends of the legs during assembly of the shelter and removable therefrom during disassembly of the shelter and a coupler attaching to the rods at a predefined distance distal to ends of the rods and defining an outer perimeter greater than the base perimeter, wherein the cover is adapted for selectably attaching about the ends of the rods during assembly and use of the shelter for covering the outer perimeter and detachment therefrom during disassembly of the shelter; and a plurality of different rod couplers wherein the rods are selectably configurable by a user with use of a different rod coupler during assembly of the shelter assembly to form a shelter having each of a plurality of canopy configurations including a pyramid, a dome, a hut, and an arch.

24. The assembly of claim 23 wherein each rod includes a stop at a predefined distance from the end of the rod, the stop configured for engaging a portion of the bracket and limiting the length of the rod that extends externally beyond the bracket for defining the outer perimeter.

25. The assembly of claim 24 wherein the stop is a clamp selectably positionable about the rod to define the predefined distance.

26. A collapsible shelter assembly having a plurality of legs, each of the legs having an upper, and a lower end, a truss system linking each pair of legs together and defining a base perimeter, a plurality of rods configured for supporting a canopy, the assembly comprising:

a plurality of brackets, each bracket having a base adapted for selectably mounting directly to the upper end of one of the legs during assembly of the shelter and removable therefrom during disassembly of the shelter and a coupler having a bore receiving the passing therethrough of one of the rods and extending a predefined length of the received rod outward from the bracket and the leg defining an outer perimeter that is greater than the base perimeter;

a cover configured to be selectably supported by the rods to form the canopy for covering the outer perimeter when the rods are attached to the brackets during assembly of the shelter and removable therefrom during disassembly of the shelter and the brackets are selectably attached to the upper ends of the legs, the cover including a corner having a rod attachment mechanism for selectably attaching the cover to ends of the rods during assembly of the shelter and detachable therefrom during disassembly of the shelter; and wherein each leg defines a cavity on the upper end and wherein each bracket is fixedly coupled to one of the rods at the predefined distance, each bracket having a base selectably insertable into the cavity of the upper end of a leg during assembly and use of the shelter and selectably removable from the cavity of the upper end of the leg during disassembly of the shelter.

27. The assembly of claim 26 wherein each rod includes a stop for limiting the length of rod received by the bore of the bracket and defining the predefined length.

28. The assembly of claim 27 wherein the stop is a clamp selectably positionable about the rod to define the predefined distance.

29. A collapsible shelter assembly having a plurality of legs, each of the legs having an upper, and a lower end, a truss system linking each pair of legs together and defining a base perimeter, a plurality of rods configured for supporting a canopy, the assembly comprising:

a plurality of brackets, each bracket having a base adapted for selectably mounting directly to the upper end of one of the legs during assembly of the shelter and removable therefrom during disassembly of the shelter and a coupler having a bore receiving the passing therethrough of one of the rods and extending a predefined length of the received rod outward from the bracket and the leg defining an outer perimeter that is greater than the base perimeter;

a cover configured to be selectably supported by the rods to form the canopy for covering the outer perimeter when the rods are attached to the brackets during assembly of the shelter and removable therefrom during disassembly of the shelter and the brackets are selectably attached to the upper ends of the legs, the cover including a corner having a rod attachment mechanism for selectably attaching the cover to ends of the rods during assembly of the shelter and detachable therefrom during disassembly of the shelter; and a plurality of different rod couplers wherein the rods are selectably configurable by a user with use of a different rod coupler during assembly of the shelter assembly to form a shelter having each of a plurality of canopy configurations including a pyramid, a dome, a hut, and an arch.

* * * * *